US006233803B1

(12) United States Patent
Rose

(10) Patent No.: US 6,233,803 B1
(45) Date of Patent: May 22, 2001

(54) ANGLED C-SQUEEZER ATTACHMENT

(75) Inventor: Craig M. Rose, Mansfield, TX (US)

(73) Assignee: Vought Aircraft Industries, Inc., Dallas, TX (US)

( * ) Notice: Subject to any disclaimer, the term of this patent is extended or adjusted under 35 U.S.C. 154(b) by 0 days.

(21) Appl. No.: 09/513,379

(22) Filed: Feb. 25, 2000

(51) Int. Cl.[7] ..... B23P 11/00

(52) U.S. Cl. ..... 29/243.53; 29/276; 29/257; 29/243.57; 29/238; 269/6; 269/3; 269/143; 269/249

(58) Field of Search ..... 29/243.53, 243.56, 29/243.57, 243.55, 238, 257, 276; 269/3, 6, 249, 143

(56) References Cited

U.S. PATENT DOCUMENTS

| | | | | |
|---|---|---|---|---|
| D. 383,655 | | 9/1997 | Juhlin et al. . | |
| 2,245,856 | | 6/1941 | Glas . | |
| 2,297,160 | | 9/1942 | Nally . | |
| 2,350,002 | * | 5/1944 | Sittert et al. | 78/48 |
| 2,365,537 | * | 12/1944 | Fischer et al. | 78/48 |
| 2,365,538 | * | 12/1944 | Fischer | 78/48 |
| 2,844,978 | | 7/1958 | Wyland et al. . | |
| 4,365,401 | * | 12/1982 | Ogren | 29/243.53 |
| 5,040,278 | * | 8/1991 | Eckold et al. | 29/243.53 |
| 5,125,158 | | 6/1992 | Casebolt et al. . | |

* cited by examiner

*Primary Examiner*—James G. Smith
*Assistant Examiner*—Lee Wilson
(74) *Attorney, Agent, or Firm*—Stetina Brunda Garred & Brucker

(57) ABSTRACT

In accordance with the present invention, there is provided a riveting device. The riveting device is provided with a body defined by a body longitudinal axis and having a pressure port formed therein. The riveting device is further provided with a jaw defined by a jaw plane. The jaw has first and second jaw extensions with the first jaw extension having a jaw plunger orifice extending therethrough. The riveting device is further provided with an angular attachment having an attachment plunger orifice extending therethrough. The angular attachment is attached to the first jaw extension with the attachment plunger orifice being axially aligned with the jaw plunger orifice. The angular attachment is further attached to the body and formed to maintain the jaw plane at an angular orientation relative to the body longitudinal axis. The riveting device is further provided with a rivet plunger having opposing rivet and base ends. The rivet plunger is engaged in slidable communication with the attachment plunger orifice and the jaw plunger orifice with the rivet end extending towards the second jaw extension and the base end in mechanical communication with the pressure port for moving the rivet plunger towards the second jaw extension.

36 Claims, 3 Drawing Sheets

ANGLED C-SQUEEZER ATTACHMENT

CROSS-REFERENCED TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to rivet devices, and more particularly to an attachment for a rivet device for maintaining the jaw thereof at an angle relative to the rest of the rivet device.

Riveting devices and in particular rivet squeezers are of increasing importance, especially in the aerospace industry. Conditions frequently arise in riveting operations in which a straight line riveting tool can not be brought into proper alignment along a line coincident with the axis of the rivet. This may often be the case where a riveting operation is required within closely confined regions, such as within an aircraft wing for example. As a result of using the tool while misaligned, an imperfect head is formed on the rivet. This may result in decreased effectiveness of the rivet.

It is therefore evident that there exists a need in the art for a rivet device which facilitates proper alignment with a rivet in comparison to the prior art devices.

BRIEF SUMMARY OF THE INVENTION

In accordance with the present invention, there is provided a riveting device. The riveting device is provided with a body defined by a body longitudinal axis and having a pressure port formed therein. The riveting device is further provided with a jaw defined by a jaw plane. The jaw has first and second jaw extensions with the first jaw extension having a jaw plunger orifice extending therethrough. The riveting device is further provided with an angular attachment having an attachment plunger orifice extending therethrough. The angular attachment is attached to the first jaw extension with the attachment plunger orifice being axially aligned with the jaw plunger orifice. The angular attachment is further attached to the body and formed to maintain the jaw plane at an angular orientation relative to the body longitudinal axis. The riveting device is further provided with a rivet plunger having opposing rivet and base ends. The rivet plunger is engaged in slidable communication with the attachment plunger orifice and the jaw plunger orifice with the rivet end extending towards the second jaw extension and the base end in mechanical communication with the pressure port for moving the rivet plunger towards the second jaw extension.

Preferably, the riveting device is further provided with a cam having opposing first and second cam surfaces and a cam pivot. The first cam surface is disposed in contact with the base end of the rivet plunger and the second cam surface is disposed in mechanical communication with a base plunger. The base plunger has a cam end and a body end. The body end is disposed within the pressure port of the body. The cam is sized and configured such that rotation of the cam about the cam pivot causes axial movement of the rivet plunger. As such, movement of the base plunger causes rotation of the cam which in turn causes movement of the rivet plunger.

Advantageously, in the preferred embodiment of the present invention, the jaw is sized and configured to rotate relative to the angular attachment about rivet plunger. In this regard, the riveting device is further provided with a bushing coupling for attaching the jaw to the angular attachment. The bushing coupling is formed to receive the rivet plunger in slidable communication therethrough, and the jaw plunger orifice is formed to axially receive the bushing coupling therein. The bushing coupling has a bushing shank formed to radially engage the angular attachment within the attachment plunger orifice. The bushing coupling has a retaining lip radially extending therefrom for capturing the second extension of the jaw with the angular attachment.

Furthermore, it is contemplated that the above described components may be integrated or otherwise retrofitted with an existing riveting device to improve the ability to align the rivet device. In such an embodiment, the present invention would take the form of an adapter kit.

As such, based on the foregoing, the present invention mitigates the inefficiencies and limitations associated with prior art rivet devices. As mentioned above, the angular attachment is particularly formed to maintain the jaw plane at an angular orientation relative to the body longitudinal axis. In this regard, it is contemplated that the angular attachment may facilitate the alignment of the rivet plunger with a rivet in such circumstances where a straight-line arrangement is prohibited by adjacent structures. Furthermore, in an embodiment of the invention, rotation of the jaw about the rivet plunger is contemplated to further enhance proper alignment of the rivet plunger. Moreover, the present invention is particularly suited to be integrated with an existing straight-line rivet device. As such, it is contemplated that the angular attachment may be selectively incorporated with such an existing rivet device in an as-needed based. In addition, the inclusion of the cam is contemplated to provide an effective mechanical method of transferring forces from the pressure port of the body of the device. Advantageously, such an arrangement avoids any hydraulic or pneumatic based configurations which have associated leakage and safety concerns.

Accordingly, the present invention represents a significant advance in the art.

BRIEF DESCRIPTION OF THE SEVERAL VIEWS OF THE DRAWING

These, as well as other features of the present invention, will become more apparent upon reference to the drawings wherein.

DETAILED DESCRIPTION OF THE INVENTION

Figure 1:
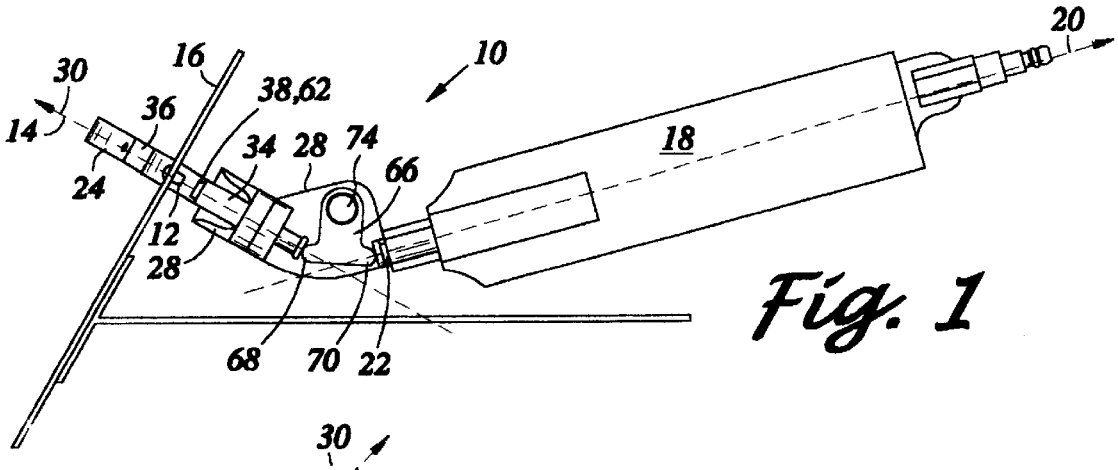
FIG. 1 is side view of the rivet device as shown in connection with a rivet and adjoining structure.
Figure 4:
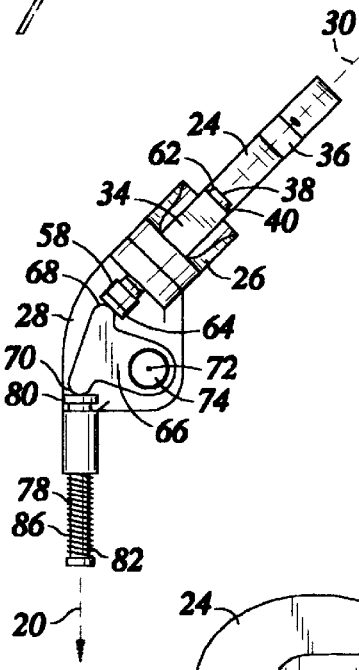
FIG. 4 is another side view of the rivet device shown in FIG. 2.
Figure 2:
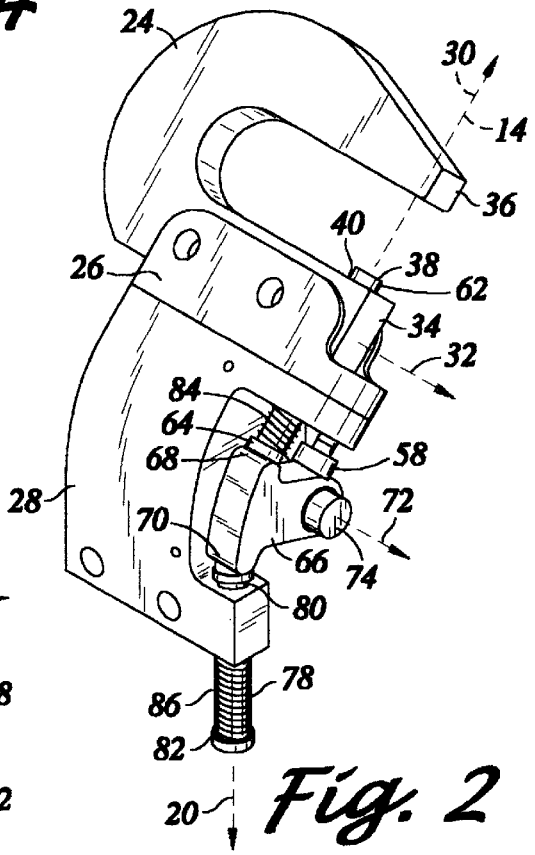
FIG. 2 is a perspective view of the rivet device of the present invention without the inclusion of the body of the rivet device.
Figure 3:
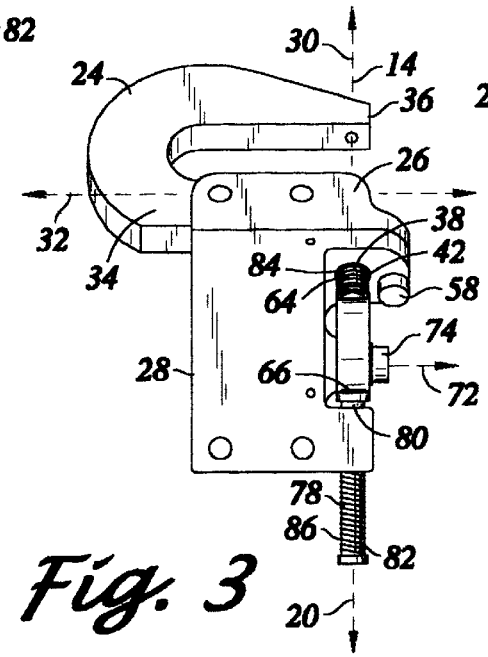
FIG. 3 is a side view of the rivet device shown in FIG. 2.
Figure 5:
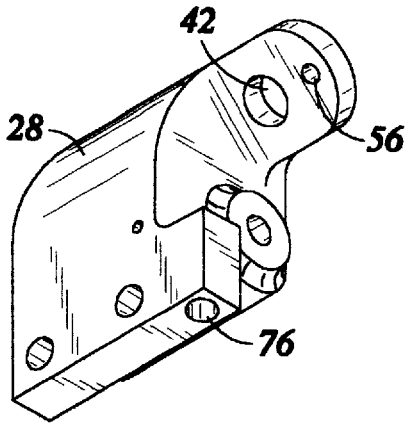
FIG. 5 is a perspective view of the angular attachment of the rivet device of the present invention.
Figure 6:
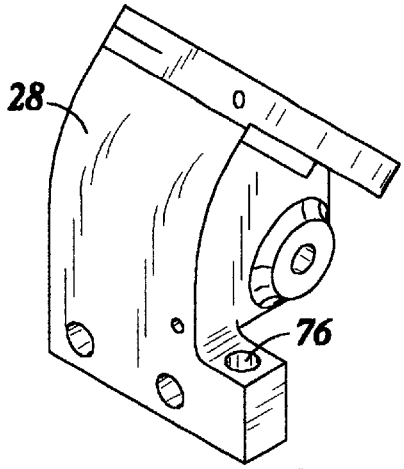
FIG. 6 is another perspective view of the angular attachment of the rivet device of the present invention.
Figure 7:
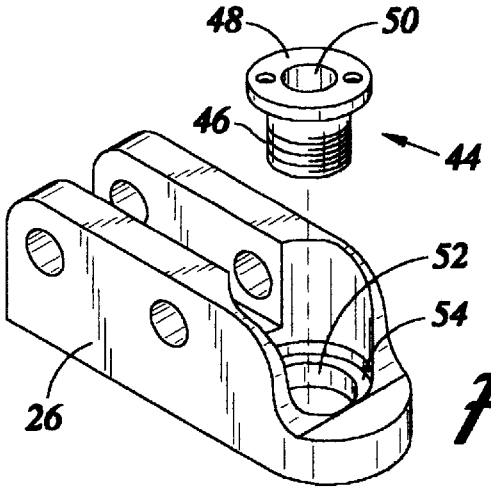
FIG. 7 is a perspective view of a jaw base and bushing coupling of the rivet device of the present invention.
Figure 8:
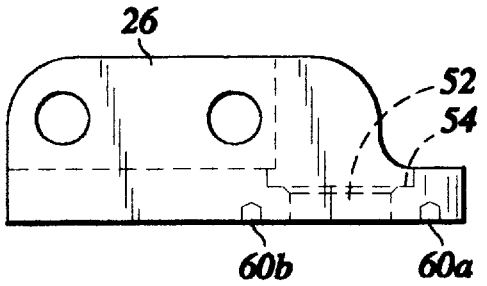
FIG. 8 is a side view of the jaw base of the present invention.
Figure 9:
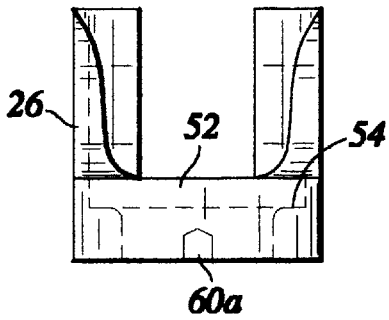
FIG. 9 is a end view of the jaw base of the present invention.

Referring now to the drawings wherein the showings are for purposes of illustrating a preferred embodiment of the present invention only, and not for purposes of limiting the same, FIGS. 1–10 illustrate a riveting device which is constructed in accordance with the present invention.

In accordance with a preferred embodiment of the present invention, referring now to FIG. 1, there is provided a riveting device 10 for attaching a rivet 12 a structure 16. It is understood that the structure 16 is symbolic in nature. The rivet 12 is generally defined by a rivet longitudinal axis 14. The riveting device 10 is provided with a body 18 which is generally defined by a body longitudinal axis 20. The body 18 has a pressure port 22 formed therein. As will be discussed further below, the pressure port 22 is sized and configured to facilitate the axial sliding movement of a base plunger 78. It is contemplated that the body 18 contains those internal components as is necessary to expel a force through the pressure port 22 to move the base plunger 78. In this regard, such internal components are contemplated to be chosen from those which are well known to one of ordinary skill in the art. In this regard, the body 18 contains components which facilitate the transfer of force and therefore pressure through the pressure port 22. Such components may be, for example, pneumatic, hydraulic, mechanical, electromechanical, or electrical in nature.

The riveting device is further provided with a jaw 24 having a first jaw extension 34 and a second jaw extension 36. The jaw 24 is formed to be generally planar in nature as defined by a jaw Y-axis 30 and a jaw X-axis 32. The a jaw Y-axis 30 and a jaw X-axis 32 cooperatively define a jaw plane. The first jaw extension 34 has a jaw plunger orifice 40 extending therethrough.

In the preferred embodiment of the present invention, the riveting device 10 is further provided with a jaw base 26 for supporting the jaw 24. The first jaw extension 34 is attachable to the jaw base 26. For ease of illustration, fasteners for facilitating such attachment, such as bolts, are not depicted in the figures.

The riveting device 10 is further provided with an angular attachment 28 having an attachment plunger orifice 42 extending therethrough. The angular attachment 28 is attached to the first jaw extension 34, preferably via attachment to the jaw base 26. The attachment plunger orifice 42 is formed to be axially aligned with the jaw plunger orifice 40.

Importantly, the angular attachment 28 is attached to the body 18 and formed to maintain the jaw plane at an angular orientation relative to the body longitudinal axis 20. In this respect, the jaw Y-axis 30 at some relative angular disposition relative to the body longitudinal axis 20, as not parallel thereto. As shown in the figures, the angular attachment 28 is preferably formed to maintain the jaw Y-axis 30 at approximately 45 degrees relative to the body longitudinal axis 20.

The riveting device 10 is further provided with a rivet plunger 38 having opposing rivet and base ends 62, 64. The rivet plunger 38 is cooperatively sized and configured to be received through the jaw plunger orifice 40 and the attachment plunger orifice 42. In this regard, the rivet plunger 38 is configured to engage the attachment plunger orifice 42 in slidable communication therethrough. The rivet end 62 is configured to extend towards the second jaw extension 36. Preferably, the rivet plunger 38 is biased away from the jaw 24. In this regard, a rivet plunger spring 84 may be disposed about and along the rivet plunger 38. The rivet plunger spring 84 may be formed to engage the base end 64 of the rivet plunger 38 and the angular attachment 28. Further, the base end 64 is disposable in mechanical communication with the pressure port 22 for moving the rivet plunger 38 towards the second jaw extension 36. In particular, the base end 64 is disposable in mechanical communication with a cam 66 and the base plunger 78 as further discussed below. Additionally, the angular attachment 28 is provided with a base plunger orifice 76 formed therein. The base plunger 78 is cooperatively sized and configured to be received through the base plunger orifice 76.

In the preferred embodiment of the present invention, the jaw 24 is sized and configured to rotate relative to the angular attachment 28 about rivet plunger 38. In this regard, referring now to FIG. 7, a bushing coupling 44 may be utilized for attaching the jaw 24 to the angular attachment 28, and in particular the jaw base 26 to the angular attachment 28. The bushing coupling 44 is defined by a bushing shank 46 which terminates at a retaining lip 48 extending radially therefrom. The jaw base 26 is provided with a jaw based opening 52 having a peripheral edge 54. The jaw base opening 52 is sized and configured to receive the bushing shank 46 therethrough with the retaining lip 48 engaging the peripheral edge 54. As mentioned above, the angular attachment 28 is provided with an attachment plunger orifice 42. The attachment plunger orifice 42 is sized and configured to radially engage the bushing shank 46. In this regard, the retaining lip 48 facilitates the capture of the second jaw extension 36 of the jaw 24 with the angular attachment 28 by engagement of the jaw base 26 at the peripheral edge 54 of the jaw base opening 52. In this respect, the jaw plunger orifice 40 has an inner diameter thereof and the retaining lip 48 has an outer diameter greater than the inner diameter of the jaw plunger orifice 40.

Further, an inner shaft 50 is formed to extend through the bushing coupling 44 along the bushing shank 46. The bushing coupling 44 is particularly formed to receive the rivet plunger 38 in slidable communication therethrough, via the inner shaft 50. In addition, it is contemplated that the bushing coupling 44 is axially aligned with the jaw plunger orifice 40 of the first jaw extension 34. Thus, the rivet plunger 38 is contemplated to axially slide within both the inner shaft 50 of the bushing coupling 44 and the jaw plunger orifice 40 of the first jaw extension 34.

Figure 10:
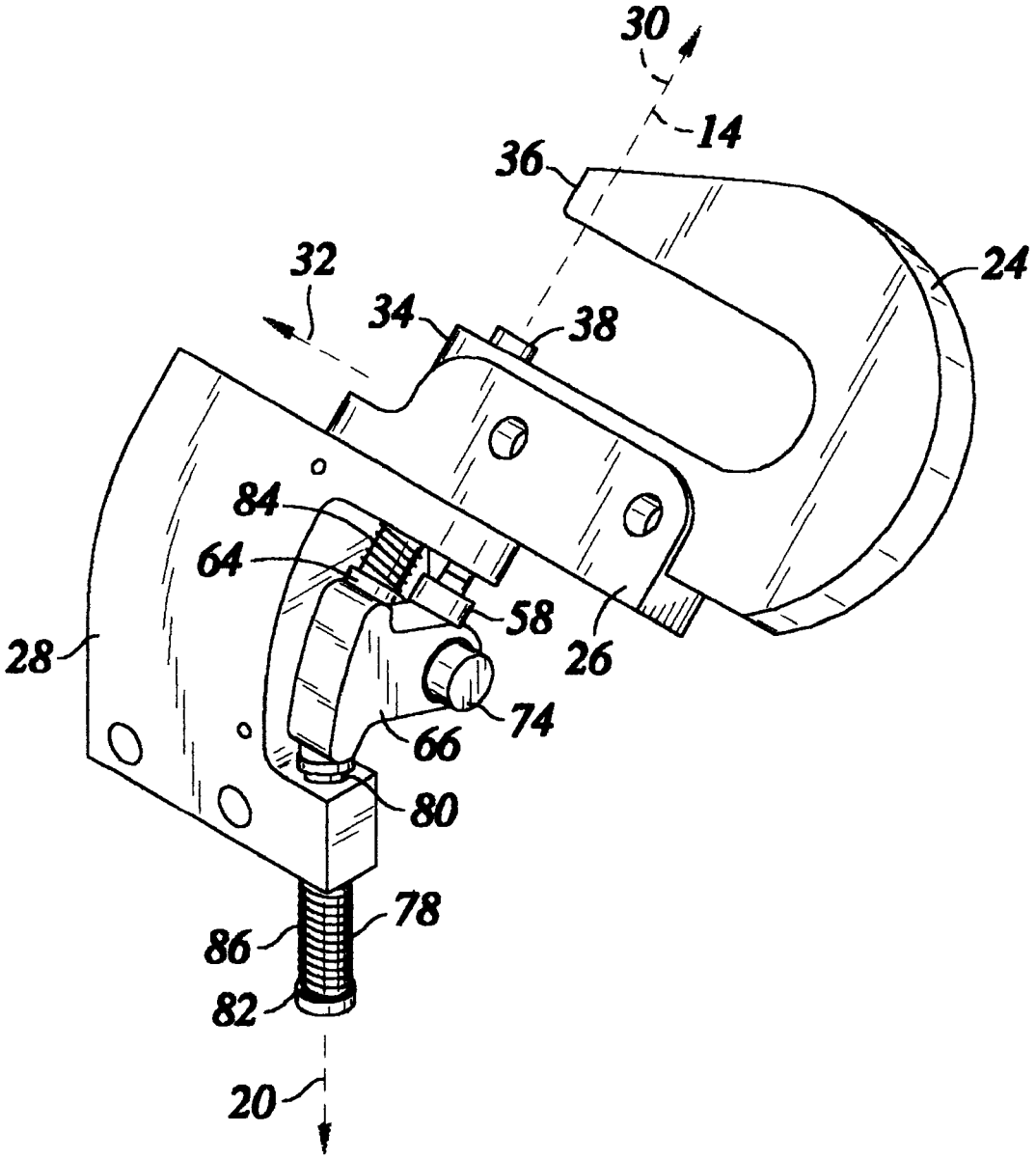
FIG. 10 is a perspective view of the rivet device shown in FIG. 2 with the jaw rotated about the pivot plunger.

In order to facilitate the maintenance of the rotational orientation of the jaw 24 and jaw base 26 relative to the angular attachment 28 about the rivet plunger 38, the rivet device 10 is further provided with an indexing pin 58. The indexing pin 58 is sized and configured to mechanically engage the jaw base 26 and the angular attachment 28. In particular, the angular attachment 28 is provided with an indexing pin opening 56. Further, the jaw base 26 is provided with locking holes 60*a–b* disposed therein. The indexing pin 58 may be configured to extend through the indexing pin opening 56 and engage a respective one of the locking holes 60*a–b*. In this regard, FIGS. 1–4 depicts the engagement of the indexing pin 58 with the locking hole 60*a*, while FIG. 10 depicts the engagement of the indexing pin 58 with the locking hole 60*b*. It is understood that the other angular dispositions may be accommodated by locating such locking holes 60*a–b* at other radial positions or via the inclusion of additional holes.

The riveting device 10 is further provided with the cam 66 having opposing first and second cam surfaces 68, 70. The cam 66 is sized and configured to rotate about a cam pivot axis 72. Preferably, the cam 66 is attached to the angular attachment 28 via a cam pivot pin 74 disposed along the base pivot axis 72. The first cam surface 68 is disposed in contact with the base end 64 of the rivet plunger 38. As mentioned above, the riveting device 10 may be provided with a base plunger 78. The base plunger 78 has opposing cam and body ends 80, 82. The cam end 80 is disposed in mechanical communication with the second cam surface 70 of the cam 66. The body end 82 is disposed within the pressure port 22 of the body 18.

Preferably, the rivet plunger 38 and the base plunger 78 have the same dimensions. In this regard, it is contemplated that the angular attachment 28 may be advantageously retrofitted with an otherwise straight-line existing jaw base 24 and body 18 arrangement. As such, such angular attachment 28 and the aforementioned components may comprises an angular adapter kit.

It is preferable that the base plunger 78 is biased away from the angular attachment 28. In this regard, the base plunger spring 86 may be disposed about and along the base plunger 78. The base plunger spring 86 may be formed to engage the body end 82 of the base plunger 78 and the angular attachment 28.

In practice, it is contemplated that a sufficient pressure exerted through the pressure port 22 is contemplated to axially move the base plunger 78 in a direction out of the pressure port 22. In so doing, the cam end 80 of the base plunger 78 is contemplated to slidably engage the second cam surface 70 and thereby rotate the cam 66. Such a rotation is contemplated to cause the first cam surface 68 to slidably engage the base end of the rivet plunger. In so doing, the rivet plunger is contemplated to be forced to axially move in a direction towards the second jaw extension 36 of the jaw 24 to perform a required riveting operation.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A riveting device comprising:

a body defined by a body longitudinal axis and having a pressure port formed therein;

a jaw defined by a jaw plane, the jaw having first and second jaw extensions, the first jaw extension having a jaw plunger orifice extending therethrough;

an angular attachment having an attachment plunger orifice extending therethrough, the angular attachment being attached to the first jaw extension with the attachment plunger orifice being axially aligned with the jaw plunger orifice, the angular attachment being attached to the body and formed to maintain the jaw plane at an angular orientation relative to the body longitudinal axis;

a rivet plunger having opposing rivet and base ends, the rivet plunger being engaged in slidable communication with the attachment plunger orifice and the jaw plunger orifice with the rivet end extending towards the second jaw extension and the base end in mechanical communication with the pressure port for moving the rivet plunger towards the second jaw extension; and a base plunger having cam and body ends, the cam end being in mechanical communication with the base end of the rivet plunger, the body end being disposed within the pressure port of the body.

2. The riveting device of claim 1 further comprising a bushing coupling for attaching the jaw to the angular attachment, the bushing coupling being formed to receive the rivet plunger in slidable communication therethrough.

3. The riveting device of claim 2 wherein the jaw plunger orifice is formed to axially receive the bushing coupling therein.

4. The riveting device of claim 2 wherein the attachment plunger orifice is formed to axially receive the bushing coupling therein.

5. The riveting device of claim 2 wherein the bushing coupling has a bushing shank formed to radially engage the angular attachment within the attachment plunger orifice.

6. The riveting device of claim 2 wherein the bushing coupling has a retaining lip radially extending therefrom for capturing the second extension of the jaw with the angular attachment.

7. The riveting device of claim 6 wherein the jaw plunger orifice has an inner diameter thereof, the retaining lip of the bushing coupling has an outer diameter greater than the inner diameter of the jaw plunger orifice.

8. The riveting device of claim 1 further comprising a cam having opposing first and second cam surfaces and a cam pivot, the first cam surface being disposed in contact with the base end of the rivet plunger, the second cam surface being disposed in mechanical communication with the body.

9. The riveting device of claim 8 further comprising a base plunger having a cam end and a body end, the cam end being in mechanical communication with the second cam surface of the cam, the body end plunger being disposed within the pressure port of the body.

10. The riveting device of claim 1 wherein the rivet plunger is biased away from the jaw.

11. The riveting device of claim 10 further comprising a rivet plunger spring in mechanical communication with the rivet plunger for biasing the rivet lunger away from the jaw.

12. The riveting device of claim 1 wherein the rivet plunger and the base plunger have the same dimensions.

13. The riveting device of claim 1 wherein the base plunger is biased away from the angular attachment.

14. The riveting device of claim 13 further comprising a base plunger spring in mechanical communication with the base plunger for biasing the rivet plunger away from the angular attachment.

15. The riveting device of claim 1 wherein the jaw is sized and configured to rotate relative to the angular attachment about rivet plunger.

16. The rivet device of claim 15 further comprising an indexing pin sized and configured to mechanically engage the jaw and the angular attachment for maintaining the rotational orientation of the jaw relative to the angular attachment.

17. The rivet device of claim 1 wherein the angular attachment is sized and configured to maintain the jaw plane at an angular orientation of 45 degrees relative to the body longitudinal axis.

18. An angular adapter kit for use with a riveting device, the riveting device having a body defined by a body longitudinal axis and having a pressure port formed therein, the riveting device further having a jaw defined by a jaw plane, the jaw having first and second jaw extensions, the first jaw extension having a jaw plunger orifice extending therethrough, the angular adapter kit comprising:

an angular attachment having an attachment plunger orifice extending therethrough, the angular attachment being attachable to the first jaw extension with the attachment plunger orifice being axially aligned with the jaw plunger orifice, the angular attachment being attachable to the body and formed to maintain the jaw plane at an angular orientation relative to the body longitudinal axis;

a rivet plunger having opposing rivet and base ends, the rivet plunger being engaged in slidable communication with the attachment plunger orifice and the jaw plunger orifice with the rivet end extending towards the second jaw extension and the base end in mechanical communication with the pressure port for moving the rivet plunger towards the second jaw extension;

a cam having opposing first and second cam surfaces and a cam pivot, the first cam surface being disposed in contact with the base end of the rivet plunger, the second cam surface disposed in mechanical communication with the body; and a base plunger having cam and body ends, the cam end being in mechanical communication with the second cam surface, the body end being disposed within the pressure port of the body.

19. The angular adapter kit of claim 18 further comprising a bushing coupling for attaching the jaw to the angular attachment, the bushing coupling being formed to receive the rivet plunger in slidable communication therethrough.

20. The angular adapter kit of claim 19 wherein the jaw plunger orifice is formed to axially receive the bushing coupling therein.

21. The angular adapter kit of claim 19 wherein the attachment plunger orifice is formed to axially receive the bushing coupling therein.

22. The angular adapter kit of claim 19 wherein the bushing coupling has a bushing shank formed to radially engage the angular attachment within the attachment plunger orifice.

23. The angular adapter kit of claim 19 wherein the bushing coupling has a retaining lip radially extending therefrom for capturing the second extension of the jaw with the angular attachment.

24. The angular adapter kit of claim 23 wherein the jaw plunger orifice has an inner diameter thereof, the retaining lip of the bushing coupling has an outer diameter greater than the inner diameter of the jaw plunger orifice.

25. The angular adapter kit of claim 18 wherein the rivet plunger is biased away from the jaw.

26. The angular adapter kit of claim 25 further having a rivet plunger spring in mechanical communication with the rivet plunger for biasing the rivet plunger away from the jaw.

27. The angular adapter kit of claim 18 further comprising a base plunger having a cam end and a base end, the cam end of the base plunger being in mechanical communication with the base end of the rivet plunger, the base end of the base plunger being disposed within the pressure port of the body.

28. The angular adapter kit of claim 27 wherein rivet plunger and the base plunger have the same dimensions.

29. The angular adapter kit of claim 27 wherein the base plunger is biased away from the angular attachment.

30. The angular adapter kit of claim 29 further having a base plunger spring in mechanical communication with the base plunger for biasing the rivet plunger away from the angular attachment.

31. The angular adapter kit of claim 18 wherein the jaw is sized and configured to rotate relative to the angular attachment about the rivet plunger.

32. The angular adapter kit of claim 31 further comprising an indexing pin sized and configured to mechanically engage the jaw and the angular attachment for maintaining the rotational orientation of the jaw relative to the angular attachment.

33. The angular adapter kit of claim 18 wherein the angular attachment is sized and configured to maintain the jaw plane at an angular orientation of 45 degrees relative to the body longitudinal axis.

34. A riveting device comprising:

a body defined by a body longitudinal axis and having a pressure port formed therein;

a jaw defined by a jaw plane, the jaw having first and second jaw extensions, the first jaw extension having a jaw plunger orifice extending therethrough; and an angular attachment having an attachment plunger orifice extending therethrough, the angular attachment being attached to the first jaw extension with the attachment plunger orifice being axially aligned with the jaw plunger orifice, the angular attachment being attached to the body and formed to maintain the jaw plane at an angular orientation relative to the body longitudinal axis;

wherein the jaw is sized and configured to rotate relative to the angular attachment about the rivet plunger.

35. An angular adapter kit for use with a riveting device, the riveting device having a body defined by a body longitudinal axis and having a pressure port formed therein, the riveting device further having a jaw defined by a jaw plane, the jaw having first and second jaw extensions, the first jaw extension having a jaw plunger orifice extending therethrough, the angular adapter kit comprising:

an angular attachment having an attachment plunger orifice extending therethrough, the angular attachment being attachable to the first jaw extension with the attachment plunger orifice being axially aligned with the jaw plunger orifice, the angular attachment being attachable to the body and formed to maintain the jaw plane at an angular orientation relative to the body longitudinal axis;

a rivet plunger having opposing rivet and base ends, the rivet plunger being engaged in slidable communication with the attachment plunger orifice and the jaw plunger orifice with the rivet end extending towards the second jaw extension and the base end in mechanical communication with the pressure port for moving the rivet plunger towards the second jaw extension; and a base plunger having a cam end and a base end, the cam end of the base plunger being in mechanical communication with the base end of the rivet plunger, the base end of the base plunger being disposed within the pressure port of the body.

36. An angular adapter kit for use with a riveting device, the riveting device having a body defined by a body longitudinal axis and having a pressure port formed therein, the riveting device further having a jaw defined by a jaw plane, the jaw having first and second jaw extensions, the first jaw extension having a jaw plunger orifice extending therethrough, the angular adapter kit comprising:

an angular attachment having an attachment plunger orifice extending therethrough, the angular attachment being attachable to the first jaw extension with the attachment plunger orifice being axially aligned with the jaw plunger orifice, the angular attachment being attachable to the body and formed to maintain the jaw plane at an angular orientation relative to the body longitudinal axis; and a rivet plunger having opposing rivet and base ends, the rivet plunger being engaged in slidable communication with the attachment plunger orifice and the jaw plunger orifice with the rivet end extending towards the second jaw extension and the base end in mechanical communication with the pressure port for moving the rivet plunger towards the second jaw extension;

wherein the jaw is sized and configured to rotate relative to the angular attachment about the rivet plunger.

* * * * *